US011808133B2

(12) United States Patent
Wicks et al.

(10) Patent No.: US 11,808,133 B2
(45) Date of Patent: Nov. 7, 2023

(54) SLIDE DRILLING

(71) Applicant: Schlumberger Technology Corporation, Sugar Land, TX (US)

(72) Inventors: Nathaniel Wicks, Somerville, MA (US); Ying Yu Fang, Katy, TX (US); Jian Wu, Houston, TX (US); Ginger Hildebrand, Houston, TX (US); Steven Duplantis, Houston, TX (US); Kam Lui, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1062 days.

(21) Appl. No.: 16/423,606

(22) Filed: May 28, 2019

(65) Prior Publication Data

US 2020/0378237 A1 Dec. 3, 2020

(51) Int. Cl.

| | |
|---|---|
| ***E21B 44/04*** | (2006.01) |
| ***E21B 7/06*** | (2006.01) |
| ***E21B 3/02*** | (2006.01) |

(52) U.S. Cl.

CPC ..... *E21B 44/04* (2013.01); *E21B 3/02* (2013.01); *E21B 7/068* (2013.01)

(58) Field of Classification Search

CPC ..... E21B 3/02; E21B 7/068; E21B 44/04
See application file for complete search history.

(56) References Cited

U.S. PATENT DOCUMENTS

| | | | |
|---|---|---|---|
| 6,050,348 | A | 4/2000 | Richarson et al. |
| 6,338,390 | B1 | 1/2002 | Tibbitts |
| 6,769,499 | B2 | 8/2004 | Cargill et al. |
| 6,802,378 | B2 | 10/2004 | Haci et al. |
| 6,918,453 | B2 | 7/2005 | Haci et al. |
| 7,096,979 | B2 | 8/2006 | Haci et al. |
| 7,152,696 | B2 | 12/2006 | Jones |
| 7,404,454 | B2 | 7/2008 | Hulick |
| 7,461,705 | B2 | 12/2008 | Hulick et al. |
| 7,588,100 | B2 | 9/2009 | Hamilton |
| 7,802,634 | B2 | 9/2010 | Boone |
| 7,810,584 | B2 | 10/2010 | Haci et al. |
| 7,823,655 | B2 | 11/2010 | Boone et al. |
| 8,360,171 | B2 | 1/2013 | Boone et al. |
| 8,387,720 | B1 | 3/2013 | Keast et al. |
| 8,528,663 | B2 | 9/2013 | Boone |

(Continued)

OTHER PUBLICATIONS

Nabors Drilling, ROCKit System, https://www.nabors.com/software/perfomnance-drilling-software/rockit-system, Aug. 22, 2018, 4 pages.

*Primary Examiner* — Dany E Akakpo
(74) *Attorney, Agent, or Firm* — Jeffrey D. Frantz

(57) ABSTRACT

Systems and methods for performing slide drilling and for determining operational parameters to be utilized during slide drilling. An example method includes commencing operation of a processing device, whereby the processing device determines a reference rotational distance of a top drive to be utilized during slide drilling. The processing device outputs a control command to the top drive to cause the top drive to rotate a drill string. The processing device also determines the reference rotational distance based on rotational distance measurements indicative of rotational distance achieved by the top drive and torque measurements indicative of torque applied to the drill string by the top drive.

17 Claims, 5 Drawing Sheets

(56) References Cited

U.S. PATENT DOCUMENTS

| | | | | |
|---|---|---|---|---|
| 8,602,126 | B2 | 12/2013 | Boone et al. | |
| 8,672,055 | B2 | 3/2014 | Boone et al. | |
| RE44,956 | E | 6/2014 | Richardson et al. | |
| RE44,973 | E | 7/2014 | Richardson et al. | |
| 8,843,220 | B1 * | 9/2014 | Rembach | E21B 3/02 175/45 |
| 8,939,233 | B2 | 1/2015 | Edbury et al. | |
| 8,939,234 | B2 | 1/2015 | Mebane, IIi et al. | |
| 9,249,655 | B1 | 2/2016 | Keast et al. | |
| 9,290,995 | B2 | 3/2016 | Boone et al. | |
| 9,309,760 | B2 | 4/2016 | Haci et al. | |
| 9,359,881 | B2 | 6/2016 | DiSantis | |
| 9,404,307 | B2 | 8/2016 | Maidla | |
| 9,415,768 | B2 | 8/2016 | Okada et al. | |
| 9,506,336 | B2 | 11/2016 | Orbell | |
| 9,593,567 | B2 | 3/2017 | Pink et al. | |
| 9,650,880 | B2 | 5/2017 | Bowley et al. | |
| 10,054,917 | B2 | 8/2018 | Penn et al. | |
| 2007/0256861 | A1 | 11/2007 | Hulick | |
| 2013/0046417 | A1 | 2/2013 | Schroter et al. | |
| 2015/0107899 | A1 * | 4/2015 | Fisher, Jr. | G01L 5/0004 73/152.48 |
| 2016/0168973 | A1 | 6/2016 | Dykstra et al. | |
| 2016/0237802 | A1 | 8/2016 | Boone et al. | |
| 2016/0245067 | A1 | 8/2016 | Haci et al. | |
| 2018/0328113 | A1 | 11/2018 | Penn et al. | |
| 2019/0301273 | A1 * | 10/2019 | Gillan | E21B 7/04 |

* cited by examiner

SLIDE DRILLING

BACKGROUND OF THE DISCLOSURE

Wells are generally drilled into the ground or ocean bed to recover natural deposits of oil, gas, and other materials that are trapped in subterranean formations. Well construction operations (e.g., drilling operations) may be performed at a wellsite by a drilling system (e.g., drilling rig) having various automated surface and subterranean equipment operating in a coordinated manner. For example, a drive mechanism, such as a top drive located at a wellsite surface, can be utilized to rotate and advance a drill string into a subterranean formation to drill a wellbore. The drill string may include a plurality of drill pipes coupled together and terminating with a drill bit. Length of the drill string may be increased by adding additional drill pipes while depth of the wellbore increases. Drilling fluid may be pumped from the wellsite surface down through the drill string to the drill bit. The drilling fluid lubricates and cools the drill bit, and carries drill cuttings from the wellbore back to the wellsite surface. The drilling fluid returning to the surface may then be cleaned and again pumped through the drill string. The equipment of the drilling system may be grouped into various subsystems, wherein each subsystem performs a different operation controlled by a corresponding local and/or a remotely located controller.

The wellsite equipment is typically monitored and controlled from a control center located at the wellsite surface. A typical control center houses a control station operable to receive sensor measurements from various sensors associated with the wellsite equipment and permit monitoring of the wellsite equipment by the wellsite control station and/or by human wellsite operators. The wellsite equipment may then be automatically controlled by the wellsite control station or manually by the wellsite operator based on the sensor measurements.

A wellbore may be drilled via directional drilling by selectively rotating the drill bit via a top drive and/or a mud motor. Directional drilling performed while the drill bit is oriented in an intended direction by the top drive and rotated by the mud motor is known in the oil and gas industry as slide drilling. During slide drilling, at least a portion of the drill string slides along a sidewall of the wellbore, thereby reducing amount of drill string weight that is transferred to the drill bit because of axial friction between the sidewall of the wellbore and the drill string. A reduced weight-on-bit causes a reduced axial contact force between the drill bit and the formation being cut by the drill bit, resulting in a reduced rate of penetration (ROP) through the formation.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus including a rotation sensor facilitating rotational distance measurements indicative of rotational distance achieved by a top drive. The apparatus also includes an electrical device facilitating torque measurements indicative of torque applied to a drill string by the top drive. The apparatus also includes a processing device having a processor and a memory storing computer program code. The processing device outputs a first control command to cause the top drive to rotate the drill string, determines a reference rotational distance based on the rotational distance measurements and the torque measurements, and during slide drilling operations outputs second control commands to cause the top drive to alternatingly rotate the drill string in opposing directions based on the determined reference rotational distance.

The present disclosure also introduces a method including commencing operation of a processing device to determine a reference rotational distance of a top drive to be utilized during slide drilling. The processing device outputs a control command to the top drive to cause the top drive to rotate a drill string. The processing device also determines the reference rotational distance based on rotational distance measurements indicative of rotational distance achieved by the top drive and torque measurements indicative of torque applied to the drill string by the top drive.

The present disclosure also introduces method including commencing operation of a processing device to determine a reference rotational distance of a top drive to be utilized during slide drilling. The processing device outputs a control command to the top drive to cause the top drive to rotate a drill string, receives rotational distance measurements indicative of rotational distance achieved by the top drive, receives torque measurements indicative of torque applied to the drill string by the top drive, and determines the reference rotational distance based on the rotational distance measurements and the torque measurements.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
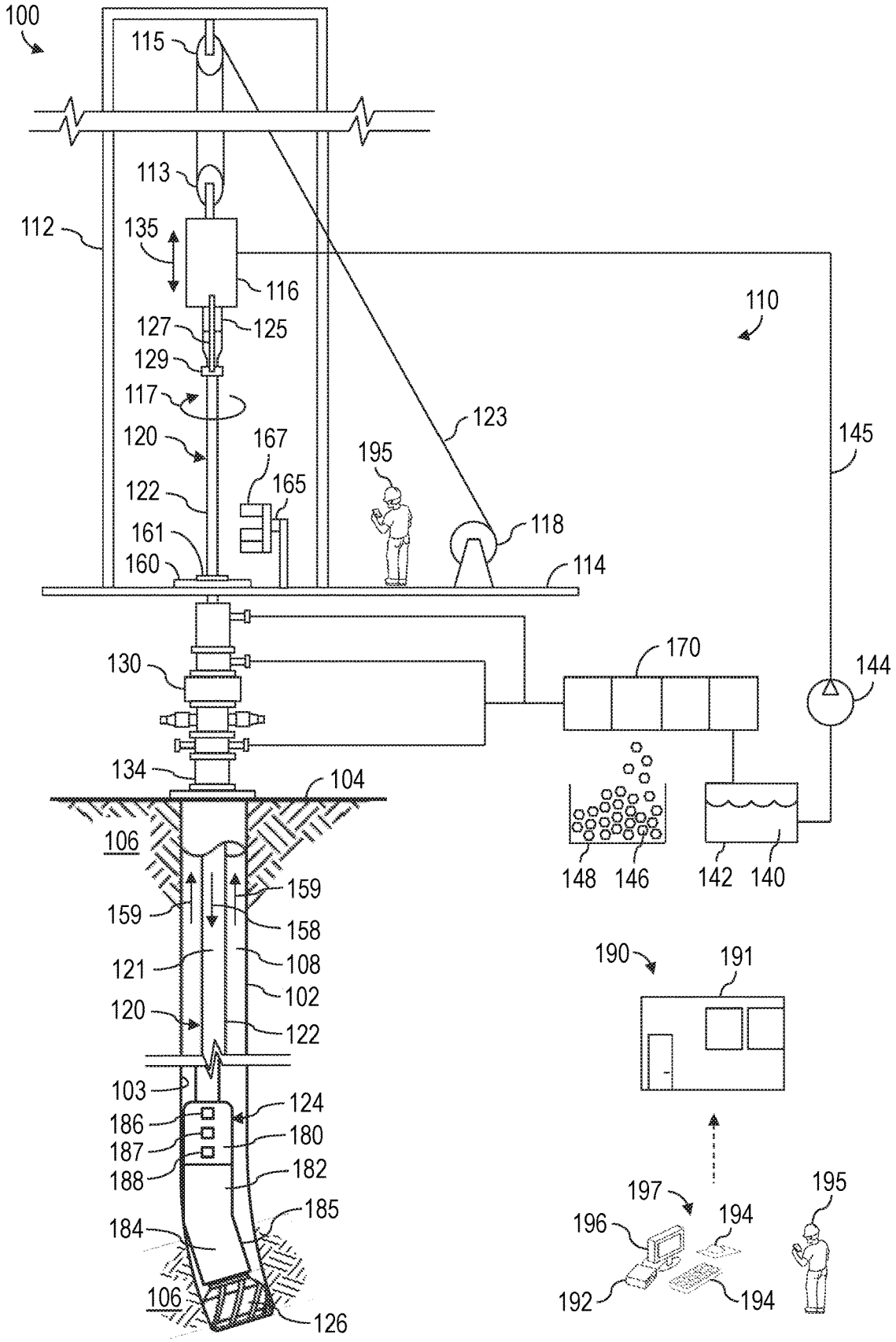
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed.

FIG. 1 is a schematic view of at least a portion of an example implementation of a well construction system 100 according to one or more aspects of the present disclosure. The well construction system 100 represents an example environment in which one or more aspects of the present disclosure described below may be implemented. The well construction system 100 may be or comprise a drilling rig and associated wellsite equipment. Although the well construction system 100 is depicted as an onshore implementation, the aspects described below are also applicable to offshore implementations.

The well construction system 100 is depicted in relation to a wellbore 102 formed by rotary and/or directional drilling from a wellsite surface 104 and extending into a subterranean formation 106. The well construction system 100 includes surface equipment 110 located at the wellsite surface 104 and a drill string 120 suspended within the wellbore 102. The surface equipment 110 may include a mast, a derrick, and/or another support structure 112 disposed over a rig floor 114. The drill string 120 may be suspended within the wellbore 102 from the support structure 112. The support structure 112 and the rig floor 114 are collectively supported over the wellbore 102 by legs and/or other support structures (not shown).

The drill string 120 may comprise a bottom-hole assembly (BHA) 124 and means 122 for conveying the BHA 124 within the wellbore 102. The conveyance means 122 may comprise drill pipe, heavy-weight drill pipe (HWDP), wired drill pipe (WDP), tough logging condition (TLC) pipe, and/or other means for conveying the BHA 124 within the wellbore 102. A downhole end of the BHA 124 may include or be coupled to a drill bit 126. Rotation of the drill bit 126 and the weight of the drill string 120 collectively operate to form the wellbore 102. The drill bit 126 may be rotated by a driver at the wellsite surface 104 and/or via a downhole mud motor 182 connected with the drill bit 126. The mud motor 182 may be a directional mud motor comprising a bent sub 184 (e.g., housing), which may be oriented in a predetermined direction during drilling operations to orient the drill bit 126 and, thus, steer the drill string 120 along a predetermined path through the formation 106. The side of the mud motor 182 aligned with the direction of the bent sub 184 and the drill bit 126 may be referred to hereinafter as a "mud motor toolface" 185. The BHA 124 may also include one or more downhole tools 180 above or below the mud motor 182.

The downhole tools 180 may be or comprise a measurement-while-drilling (MWD) or logging-while-drilling (LWD) tool comprising a sensor package 186 operable for the acquisition of measurement data pertaining to the BHA 124, the wellbore 102, and/or the formation 106. The sensor package 186 may comprise a inclination and/or another sensor, such as one or more accelerometers, magnetometers, gyroscopic sensors (e.g., micro-electro-mechanical system (MEMS) gyros), and/or other sensors for determining the orientation of one or more portions (e.g., the BHA 124, the downhole tool 180, the mud motor 182) of the tool string 120 relative to the wellbore 102 and/or the wellsite surface 104. The sensor package 186 may comprise a depth correlation tool utilized to determine and/or log position (i.e., location) of one or more portions (e.g., the BHA 124, the downhole tool 180, the mud motor 182) the tool string 120 within the formation 106 and/or with respect to the wellsite surface 104.

One or more of the downhole tools 180 and/or another portion of the BHA 124 may also comprise a telemetry device 187 operable for communication with the surface equipment 110, such as via mud-pulse telemetry. One or more of the downhole tools 180 and/or another portion of the BHA 124 may also comprise a downhole processing device 188 operable to receive, process, and/or store information received from the surface equipment 110, the sensor package 186, and/or other portions of the BHA 124. The processing device 188 may also store executable computer programs (e.g., program code instructions), including for implementing one or more aspects of the operations described herein.

The support structure 112 may support the driver, such as a top drive 116, operable to connect (perhaps indirectly) with an upper end of the drill string 120, and to impart rotary motion 117 and vertical motion 135 to the drill string 120, including the drill bit 126. However, another driver, such as a kelly (not shown) and a rotary table 160, may be utilized in addition to or instead of the top drive 116 to impart the rotary motion 117 to the drill string 120. The top drive 116 and the connected drill string 120 may be suspended from the support structure 112 via a hoisting system or equipment, which may include a traveling block 113, a crown block 115, and a draw works 118 storing a support cable or line 123. The crown block 115 may be connected to or otherwise supported by the support structure 112, and the traveling block 113 may be coupled with the top drive 116. The draw works 118 may be mounted on or otherwise supported by the rig floor 114. The crown block 115 and traveling block 113 comprise pulleys or sheaves around which the support line 123 is reeved to operatively connect the crown block 115, the traveling block 113, and the draw works 118 (and perhaps an anchor). The draw works 118 may thus selectively impart tension to the support line 123 to lift and lower the top drive 116, resulting in the vertical motion 135. The draw works 118 may comprise a drum, a base, and a prime mover (e.g., an engine or motor) (not shown) operable to drive the drum to rotate and reel in the support line 123, causing the traveling block 113 and the top drive 116 to move upward. The draw works 118 may be operable to reel out the support line 123 via a controlled rotation of the drum, causing the traveling block 113 and the top drive 116 to move downward.

The top drive 116 may comprise a grabber, a swivel (neither shown), elevator links 127 terminating with an elevator 129, and a drive shaft 125 operatively connected with a prime mover (e.g., an electric motor 202 shown in FIG. 2), such as via a gear box or transmission (not shown). The drive shaft 125 may be selectively coupled with the upper end of the drill string 120 and the prime mover may be selectively operated to rotate the drive shaft 125 and the drill string 120 coupled with the drive shaft 125. Hence, during drilling operations, the top drive 116, in conjunction with operation of the draw works 118, may advance the drill string 120 into the formation 106 to form the wellbore 102. The elevator links 127 and the elevator 129 of the top drive 116 may handle tubulars (e.g., drill pipes, drill collars, casing joints, etc.) that are not mechanically coupled to the drive shaft 125. For example, when the drill string 120 is being tripped into or out of the wellbore 102, the elevator 129 may grasp the tubulars of the drill string 120 such that the tubulars may be raised and/or lowered via the hoisting equipment mechanically coupled to the top drive 116. The top drive 116 may have a guide system (not shown), such as rollers that track up and down a guide rail on the support structure 112. The guide system may aid in keeping the top drive 116 aligned with the wellbore 102, and in preventing the top drive 116 from rotating during drilling by transferring reactive torque to the support structure 112.

The well construction system 100 may further include a drilling fluid circulation system or equipment operable to circulate fluids between the surface equipment 110 and the drill bit during drilling and other operations. For example, the drilling fluid circulation system may be operable to inject a drilling fluid from the wellsite surface 104 into the wellbore 102 via an internal fluid passage 121 extending longitudinally through the drill string 120. The drilling fluid circulation system may comprise a pit, a tank, and/or other fluid container 142 holding the drilling fluid (i.e., mud) 140, and one or more pumps 144 operable to move the drilling fluid 140 from the container 142 into the fluid passage 121 of the drill string 120 via a fluid conduit 145 extending from the pump 144 to the top drive 116 and an internal passage extending through the top drive 116.

During drilling operations, the drilling fluid may continue to flow downhole through the internal passage 121 of the drill string 120, as indicated by directional arrow 158. The drilling fluid may exit the BHA via ports in the drill bit and then circulate uphole through an annular space 108 ("annulus") of the wellbore 102 defined between an exterior of the drill string 120 and the sidewall of the wellbore 102, such flow being indicated by directional arrows 159. In this manner, the drilling fluid lubricates the drill bit and carries formation cuttings uphole to the wellsite surface 104. The drilling fluid flowing downhole through the internal passage 121 may selectively actuate the mud motor 182 to rotate the drill bit 126 instead of or in addition to the rotation of the drill string 120. Accordingly, rotation of the drill bit 126 caused by the top drive 116 and/or mud motor 182 may advance the drill string 120 through the formation 106 to form the wellbore 102.

The well construction system 100 may further include fluid control equipment 130 for maintaining well pressure control and for controlling fluid being discharged from the wellbore 102. The fluid control equipment 130 may be mounted on top of a wellhead 134. The returning drilling fluid may exit the annulus 108 via one or more valves of the fluid control equipment 130, such as a bell nipple, an RCD, and/or a ported adapter (e.g., a spool, cross adapter, a wing valve, etc.) located below one or more portions of a BOP stack. The returning drilling fluid may then pass through drilling fluid reconditioning equipment 170 to be cleaned and reconditioned before returning to the fluid container 142. The drilling fluid reconditioning equipment 170 may separate drill cuttings 146 from the returning drilling fluid into a cuttings container 148.

An iron roughneck 165 may be positioned on the rig floor 114. The iron roughneck 165 may comprise a torqueing portion 167, such as may include a spinner and a torque wrench comprising a lower tong and an upper tong. The torqueing portion 167 of the iron roughneck 165 may be moveable toward and at least partially around the drill string 120, such as may permit the iron roughneck 165 to make up and break out connections of the drill string 120. The torqueing portion 167 may also be moveable away from the drill string 120, such as may permit the iron roughneck 165 to move clear of the drill string 120 during drilling operations. The spinner of the iron roughneck 165 may be utilized to apply low torque to make up and break out threaded connections between tubulars of the drill string 120, and the torque wrench may be utilized to apply a higher torque to tighten and loosen the threaded connections.

A set of slips 161 may be located on the rig floor 114, such as may accommodate therethrough the drill string 120 during tubular make up and break out operations, tubular running operations, and drilling operations. The slips 161 may be in an open position during running and drilling operations to permit advancement of the drill string 120, and in a closed position to clamp the upper end (e.g., uppermost tubular) of the drill string 120 to thereby suspend and prevent advancement of the drill string 120 within the wellbore 102, such as during the make up and break out operations.

The surface equipment 110 of the well construction system 100 may also comprise a control center 190 from which various portions of the well construction system 100, such as the top drive 116, the hoisting system, the tubular handling system, the drilling fluid circulation system, the well control system, the BHA, among other examples, may be monitored and controlled. The control center 190 may be located on the rig floor 114 or another location of the well construction system 100, such as the wellsite surface 104. The control center 190 may comprise a facility 191 (e.g., a room, a cabin, a trailer, etc.) containing a control workstation 197, which may be operated by a human wellsite operator 195 to monitor and control various wellsite equipment or portions of the well construction system 100. The control workstation 197 may comprise or be communicatively connected with a processing device 192 (e.g., a controller, a computer, etc.), such as may be operable to receive, process, and output information to monitor operations of and provide control to one or more portions of the well construction system 100. For example, the processing device 192 may be communicatively connected with the various surface and downhole equipment described herein, and may be operable to receive signals from and transmit signals to such equipment to perform various operations described herein. The processing device 192 may store executable program code, instructions, and/or operational parameters or set-points, including for implementing one or more aspects of methods and operations described herein. The processing device 192 may be located within and/or outside of the facility 191.

The control workstation 197 may be operable for entering or otherwise communicating control commands to the processing device 192 by the wellsite operator 195, and for displaying or otherwise communicating information from the processing device 192 to the wellsite operator 195. The control workstation 197 may comprise a plurality of human-machine interface (HMI) devices, including one or more input devices 194 (e.g., a keyboard, a mouse, a joystick, a touchscreen, etc.) and one or more output devices 196 (e.g., a video monitor, a touchscreen, a printer, audio speakers, etc.). Communication between the processing device 192, the input and output devices 194, 196, and the various wellsite equipment may be via wired and/or wireless communication means. However, for clarity and ease of understanding, such communication means are not depicted, and a person having ordinary skill in the art will appreciate that such communication means are within the scope of the present disclosure.

Well construction systems within the scope of the present disclosure may include more or fewer components than as described above and depicted in FIG. 1. Additionally, various equipment and/or subsystems of the well construction system 100 shown in FIG. 1 may include more or fewer components than as described above and depicted in FIG. 1. For example, various engines, motors, hydraulics, actuators, valves, and/or other components not explicitly described herein may be included in the well construction system 100, and are within the scope of the present disclosure.

The well construction system 100 may be utilized to perform directional drilling by selectively rotating the drill bit 126 via the top drive 116 and/or the mud motor 182. During normal (e.g., non-directional) drilling operations, known in the oil and gas industry as "rotary drilling", both the top drive 116 and the mud motor 182 may rotate the drill bit 126 resulting in a total drill bit rotational rate that is equal to the rotational rates of both the top drive 116 and the mud motor 182. To cause the drill string 120 to drill in an intended lateral direction (i.e., to turn), the top drive 116 may stop rotating and orient the mud motor toolface 185 and, thus, the drill bit 126 in the intended direction. The mud motor 182 may then continue to rotate the drill bit while weight-on-bit is applied, thereby causing the drill string 120 to advance in the intended direction through the formation 106 forming the wellbore 102. Directional drilling performed while the drill bit 126 is oriented in the intended direction by the top drive 116 and rotated by the mud motor 182 is known in the oil and gas industry as "slide drilling". Rotary and slide drilling operations may be alternated periodically to steer the drill string 120 to form a deviated wellbore 102 along a predetermined path through the formation 106. Typically, an entire wellbore 102 can be drilled through a combination of rotary drilling (with higher ROP, but no control over wellbore trajectory) and slide drilling (with lower ROP, but with control of the wellbore trajectory).

During slide drilling, at least a portion of the BHA 124 and/or the conveyance means 122, opposite the direction of the mud motor toolface 185 slides along a sidewall 103 of the wellbore 102. Thus, during slide drilling, a reduced amount of drill string weight is transferred to the drill bit 126 because of axial friction between the sidewall 103 of the wellbore 102 and the drill string 120. A reduced weight-on-bit results in a reduced axial contact force between the drill bit 126 and the formation 106 (i.e., rock) being cut by the drill bit 126, resulting in a reduced ROP through the formation 106.

The present disclosure is further directed to various implementations of systems and/or methods for monitoring and controlling slide drilling operations to reduce axial friction between the drill string 120 and the sidewall 103 of the wellbore 102 and, thus, increase ROP through the formation 106. The systems and/or methods within the scope of the present disclosure may be utilized to monitor (i.e., measure) and control operational parameters of the top drive 116 based on predetermined operational set-points. For example, the systems and/or methods within the scope of the present disclosure may cause the top drive 116 to rotate the drill string 120 in alternating (i.e., opposite) rotational directions in an oscillating manner to lower the axial friction between the drill string 120 and the sidewall 103 of the wellbore 102, thereby increasing weight transfer to the drill bit 126, resulting in a higher ROP, while also controlling directional orientation of the mud motor toolface 185.

Figure 2:
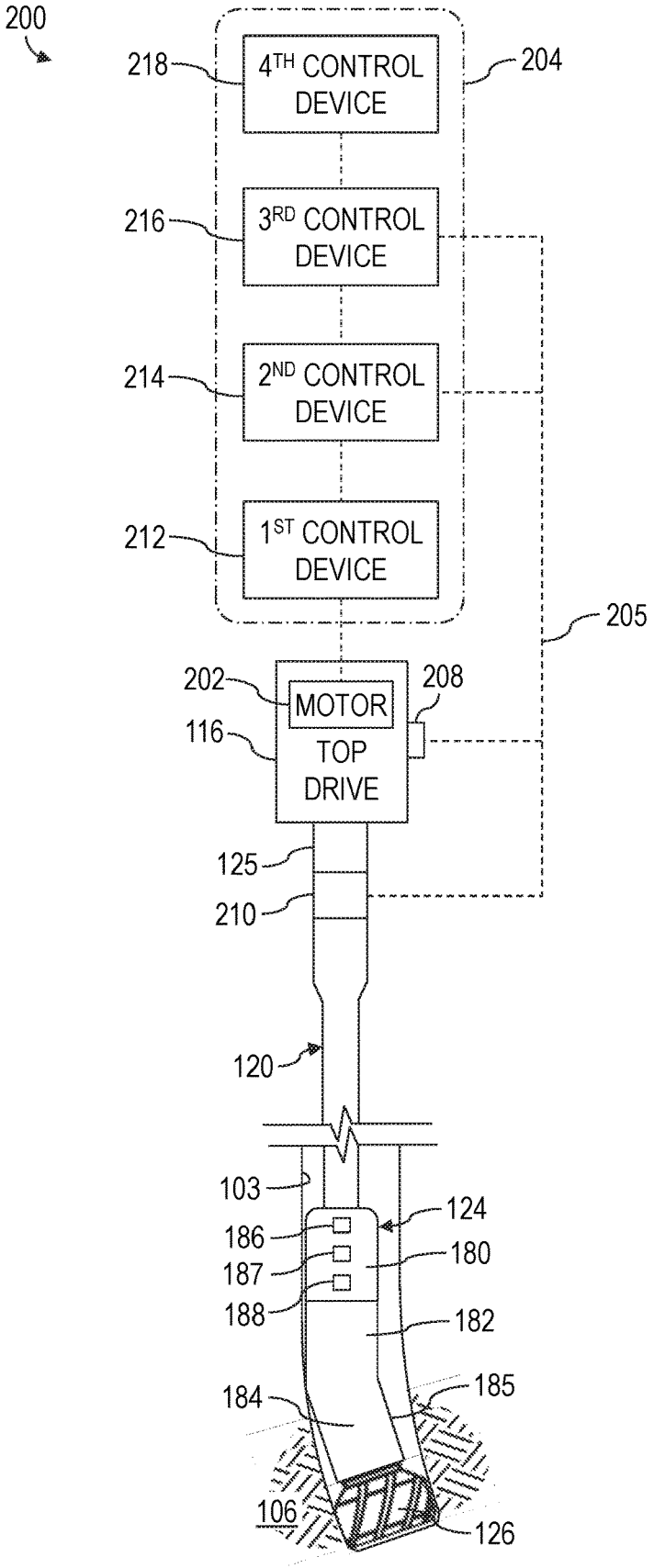
FIG. 2 is a schematic view of at least a portion of an example implementation of apparatus according to one or more aspects of the present disclosure.

FIG. 2 is a schematic view of at least a portion of an example implementation of a control system 200 for monitoring and controlling operation of a top drive 116 according to one or more aspects of the present disclosure. The control system 200 may form a portion of or operate in conjunction with the well construction system 100 shown in FIG. 1 and, thus, may comprise one or more features of the well construction system 100 shown in FIG. 1, including where indicated by the same reference numerals. Accordingly, the following description refers to FIGS. 1 and 2, collectively.

The top drive 116 may comprise an electric motor 202 operatively connected to a drive shaft 125 of the top drive 116 via a transmission or gear box (not shown). During drilling operations, the drive shaft 125 may be coupled with the top end of a drill string 120 terminating at the lower end with a BHA 124. The BHA 124 may include a downhole tool 180 and a mud motor 182 configured to rotate a drill bit 126. The mud motor 182 may be connected to the drill bit via a bent sub 184. The mud motor 182 may comprise a mud motor toolface 185 aligned with the direction of the bent sub 184 and the drill bit 126. The control system 200 may be utilized to control slide drilling operations, at least partially, by monitoring and controlling operation of the electric motor 202 operatively connected to the drive shaft 125 via a transmission or gear box (not shown).

The control system 200 may comprise one or more control devices 204 (e.g., information processing devices), such as, for example, variable frequency drives (VFDs), programmable logic controllers (PLCs), computers (PCs), industrial computers (IPC), or other controllers equipped with control logic, communicatively connected with various sensors and actuators of the top drive 116 and/or the control system 200. One or more of the control devices 204 may be in real-time communication with such sensors and actuators, and utilized to monitor and/or control various portions, components, and equipment of the top drive 116. Communication between one or more of the control devices 204 and the sensors and actuators may be via wired and/or wireless communication means 205. A person having ordinary skill in the art will appreciate that such communication means are within the scope of the present disclosure.

The monitoring system 200 may comprise one or more rotation sensors 208 operatively connected with and/or disposed in association with the top drive 116. The rotation sensor 208 may be operable to output or otherwise facilitate rotational position measurements (e.g., sensor signals or information) indicative of or operable to facilitate determination of rotational (i.e., angular) position of the drive shaft 125 of the top drive 116. The rotation sensor 208 may be communicatively connected with one or more of the control devices 204 and operable to output the rotational position measurements to one or more of the control devices 204. The rotation sensor 208 may be disposed or installed in association with, for example, the electric motor 202 to monitor rotational position of the electric motor 202 and, thus, the drive shaft 125. The rotation sensor 208 may be disposed or installed in association with, for example, a rotating member of the gear box to monitor rotational position of the rotating member and, thus, the drive shaft 125. The rotation sensor 208 may be disposed or installed in direct association with, for example, the drive shaft 125 to monitor rotational position of the drive shaft 125. The rotational position measurements may be further indicative of rotational distance (i.e., number of rotations), rotational speed, and rotational acceleration of the motor 202 and the drive shaft 125. The rotation sensor 208 may be or comprise, for example, an encoder, a rotary potentiometer, and a rotary variable-differential transformer (RVDT).

The monitoring system 200 may further comprise one or more electrical devices, each operable to output or otherwise facilitate torque measurements (e.g., signals or information) indicative of or operable to facilitate determination of torque generated, output, or facilitated by the top drive 116. For example, the monitoring system 200 may comprise a torque sensor 210 (e.g., a torque sub) operable to output or otherwise facilitate torque measurements (e.g., signals or information) indicative of or operable to facilitate determination of torque that was output by the drive shaft 125 of the top drive 116 to the drill string 120. The torque sensor 210 may be communicatively connected with one or more of the control devices 204 and operable to output the torque measurements to one or more of the control devices 204. The torque sensor 210 may be mechanically connected or otherwise disposed between the drive shaft 125 and the upper end of the drill string 120, such as may permit the torque sensor 210 to transfer and measure torque. The torque sensor 210 may also facilitate determination of rotational position, rotational distance, rotational speed, and rotational acceleration of the drive shaft 125.

The control devices 204 may be divided into or otherwise comprise hierarchical control levels or layers. A first control level may comprise a first control device 212 (i.e., an actuator control device), such as, for example, a VFD operable to directly power and control (i.e., drive) the electric motor 202 of the top drive 116. The first control device 212 may be electrically connected with the electric motor 202 and/or supported by or disposed in close association with the top drive 116. The first control device 212 may be operable to control operation (e.g., rotational speed and torque) of the electric motor 202 and, thus, the drive shaft 125 of the top drive 116. The first control device 212 may control electrical power (e.g., current, voltage, frequency) delivered to the electric motor 202. The first control device 212 may be further operable to calculate or determine torque and/or rotational speed generated or output by the electric motor 202, such as based on the electrical power (e.g., current, voltage, frequency) delivered to the electric motor 202. The first control device 212 may thus be operable to output or otherwise facilitate torque measurements (e.g., signals or information) indicative of or operable to facilitate determination of torque output to the drill string 120 by the top drive 116. The first control device 212 may be communicatively connected with one or more of the other control devices 204 and operable to output the torque measurements to one or more of the other control devices 204. The first control device 212 may be further operable to output or otherwise facilitate rotational speed and/or acceleration measurements indicative of or operable to facilitate determination of operating speed and/or acceleration of the top drive 116.

A second control level may comprise a second control device 214 (i.e., a direct control device), such as, for example, a PLC operable to control the electric motor 202 of the top drive 116 via the first control device 212. The second control device 214 may be imparted with and operable to execute program code instructions, such as rigid computer programing. The second control device 214 may be a local control device disposed in association with the top drive 116 or another portion of the drill string drive system of the well construction system 100 and operable to control the top drive 116 and/or other portions of the drill string drive system. The second control device 214 may be communicatively connected with the first control device 212 and operable to receive torque and other measurements from the first control device 212 and output control signals or information to the first control device 212 to control the rotational position, rotational distance, rotational speed, and/or torque of the motor 202. The second control device 214 may be communicatively connected with the rotation sensor 208 and operable to receive rotational position, rotational distance, rotational speed, and/or rotational acceleration measurements output by the rotation sensor 208. The second control device 214 may be communicatively connected with the torque sensor 210 and operable to receive the torque and other measurements output by the torque sensor 210. The second control device 214 may have or operate at a sampling rate between about ten hertz (Hz) and about one kilohertz (kHz).

A third control level may comprise a third control device 216 (i.e., a coordinated control device), such as, for example, a PC, an IPC, and/or another processing device. The third control device 216 may be imparted with and operable to execute program code instructions, including high level programming languages, such as C, and C++, among other examples, and may be used with program code instructions running in a real time operating system (RTOS). The third control device 216 may be a system-wide control device operable to control a plurality of devices and/or subsystems of the well construction system 100. The third control device 216 may be or form at least a portion of the processing device 192 shown in FIG. 1. The third control device 216 may be operable to control the electric motor 202 of the top drive 116 via the first and second control device 212, 214. The third control device 216 may be communicatively connected with the second control device 214 and operable to receive torque and other measurements from the first control device 212 via the second control device 214. The third control device 216 may be operable to output control signals or information to the first control device 212 via the second control device 214 to control the rotational position, rotational distance, rotational speed, and/or torque of the motor 202. The third control device 216 may be communicatively connected with the rotation sensor 208 and operable to receive rotational position, rotational distance, rotational speed, and/or rotational acceleration measurements output by the rotation sensor 208. The third control device 216 may be communicatively connected with the torque sensor 210 and operable to receive the torque and other measurements output by the torque sensor 210. The third control device 216 may have or operate at a sampling rate between about ten Hz and about 100 Hz.

A fourth control level may comprise a fourth control device 218 (i.e., an orchestration control device), such as, for example, a PC, an IPC, and/or another processing device. The fourth control device 218 may be imparted with and operable to execute program code instructions, including orchestration software for high-level control of the drilling operations of the well construction system 100. The fourth control device 218 may be or form at least a portion of the processing device 192 shown in FIG. 1. The third control device 216 may be operable to control the electric motor 202 of the top drive 116 via the first, second, and third control device 212, 214, 216. The third control device 216 may be communicatively connected with the third control device 214 and operable to receive torque and other measurements from the first control device 212 via the second and third control devices 214, 216. The fourth control device 218 may be operable to output control signals or information to the first control device 212 via the second and third control devices 214, 216 to control the rotational position, rotational distance, rotational speed, and/or torque of the motor 202. The fourth control device 218 may have or operate at a sampling rate ranging from about one or several seconds to about one or several minutes.

Figure 3:
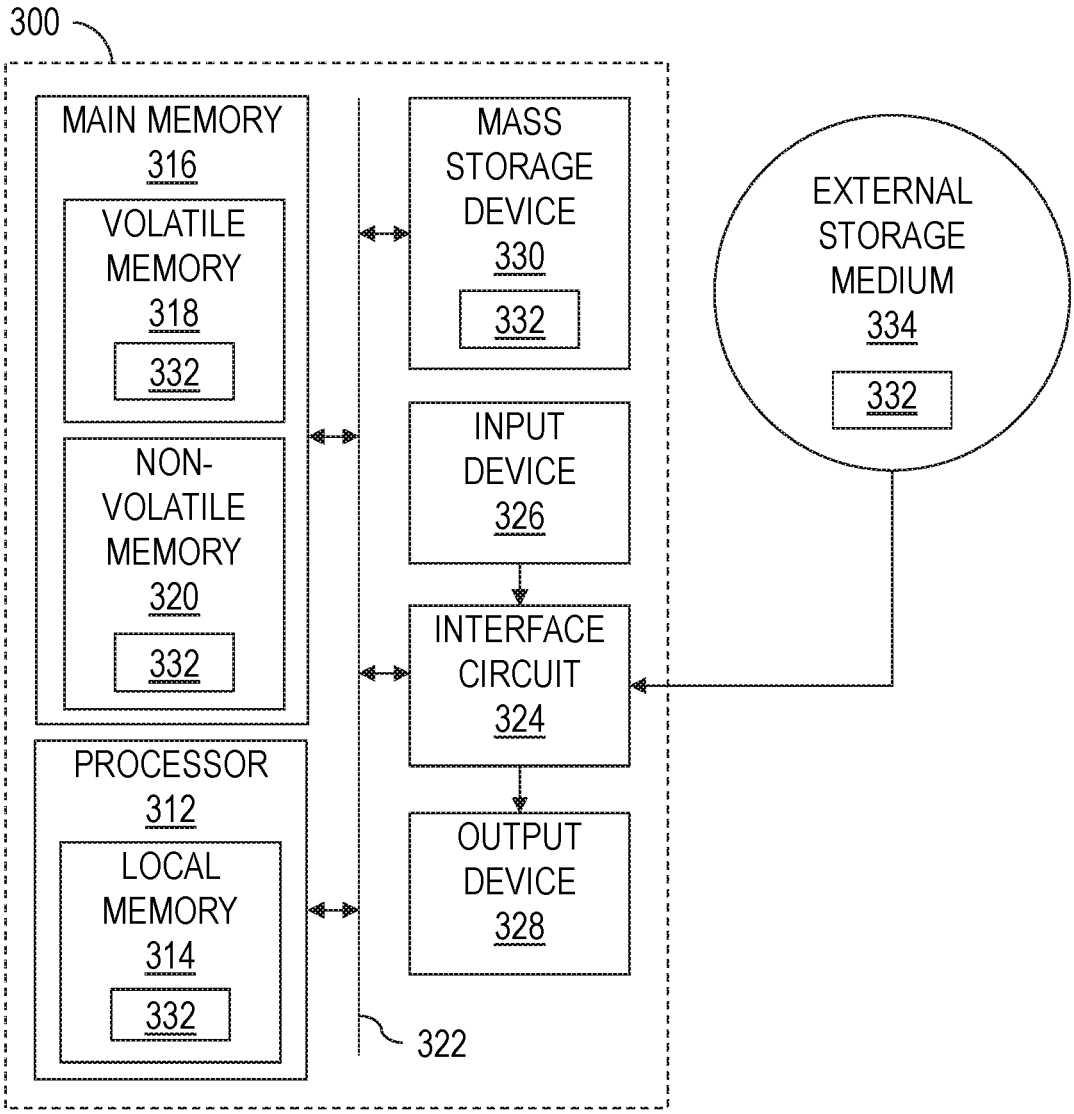
FIG. 3 is a schematic view of at least a portion of an example implementation of apparatus according to one or more aspects of the present disclosure.

FIG. 3 is a schematic view of at least a portion of an example implementation of a processing system 300 (or device) according to one or more aspects of the present disclosure. The processing system 300 may be or form at least a portion of one or more processing devices, equipment controllers, and/or other electronic devices shown in one or more of the FIGS. 1 and 2. Accordingly, the following description refers to FIGS. 1-3, collectively.

The processing system 300 may be or comprise, for example, one or more processors, controllers, special-purpose computing devices, PCs (e.g., desktop, laptop, and/or tablet computers), personal digital assistants, smartphones, IPCs, PLCs, servers, interne appliances, and/or other types of computing devices. The processing system 300 may be or form at least a portion of the processing devices 192, 188 shown in FIG. 1. The processing system 300 may be or form at least a portion of the control devices 212, 214, 216, 218 shown in FIG. 2. Although it is possible that the entirety of the processing system 300 is implemented within one device, it is also contemplated that one or more components or functions of the processing system 300 may be implemented across multiple devices, some or an entirety of which may be at the wellsite and/or remote from the wellsite.

The processing system 300 may comprise a processor 312, such as a general-purpose programmable processor. The processor 312 may comprise a local memory 314, and may execute machine-readable and executable program code instructions 332 (i.e., computer program code) present in the local memory 314 and/or another memory device. The processor 312 may execute, among other things, the program code instructions 332 and/or other instructions and/or programs to implement the example methods, processes, and/or operations described herein. For example, the program code instructions 332, when executed by the processor 312 of the processing system 300, may cause a top drive 116 to perform example methods and/or operations described herein. The program code instructions 332, when executed by the processor 312 of the processing system 300, may also or instead cause the processor 312 to receive and process sensor data (e.g., sensor measurements), and output control commands to the motor 202 of the top drive 116 based on predetermined set-points and the received sensor data.

The processor 312 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Examples of the processor 312 include one or more INTEL microprocessors, microcontrollers from the ARM and/or PICO families of microcontrollers, embedded soft/hard processors in one or more FPGAs.

The processor 312 may be in communication with a main memory 316, such as may include a volatile memory 318 and a non-volatile memory 320, perhaps via a bus 322 and/or other communication means. The volatile memory 318 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 320 may be, comprise, or be implemented by read-only memory, flash memory, and/or other types of memory devices. One or more memory controllers (not shown) may control access to the volatile memory 318 and/or non-volatile memory 320.

The processing system 300 may also comprise an interface circuit 324, which is in communication with the processor 312, such as via the bus 322. The interface circuit 324 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 324 may comprise a graphics driver card. The interface circuit 324 may comprise a communication device, such as a modem or network interface card to facilitate exchange of data with external computing devices via a network (e.g., Ethernet connection, digital subscriber line (DSL), telephone line, coaxial cable, cellular telephone system, satellite, etc.).

The processing system 300 may be in communication with various sensors, video cameras, actuators, processing devices, equipment controllers, and other devices of the well construction system via the interface circuit 324. The interface circuit 324 can facilitate communications between the processing system 300 and one or more devices by utilizing one or more communication protocols, such as an Ethernet-based network protocol (such as ProfiNET, OPC, OPC/UA, Modbus TCP/IP, EtherCAT, UDP multicast, Siemens S7 communication, or the like), a proprietary communication protocol, and/or another communication protocol.

One or more input devices 326 may also be connected to the interface circuit 324. The input devices 326 may permit human wellsite operators 195 to enter the program code instructions 332, which may be or comprise control commands, operational parameters, operational thresholds, and/or other operational set-points. The program code instructions 332 may further comprise modeling or predictive routines, equations, algorithms, processes, applications, and/or other programs operable to perform example methods and/or operations described herein. The input devices 326 may be, comprise, or be implemented by a keyboard, a mouse, a joystick, a touchscreen, a track-pad, a trackball, an isopoint, and/or a voice recognition system, among other examples. One or more output devices 328 may also be connected to the interface circuit 324. The output devices 328 may permit for visualization or other sensory perception of various data, such as sensor data, status data, and/or other example data. The output devices 328 may be, comprise, or be implemented by video output devices (e.g., an LCD, an LED display, a CRT display, a touchscreen, etc.), printers, and/or speakers, among other examples. The one or more input devices 326 and the one or more output devices 328 connected to the interface circuit 324 may, at least in part, facilitate the HMIs described herein.

The processing system 300 may comprise a mass storage device 330 for storing data and program code instructions 332. The mass storage device 330 may be connected to the processor 312, such as via the bus 322. The mass storage device 330 may be or comprise a tangible, non-transitory storage medium, such as a floppy disk drive, a hard disk drive, a compact disk (CD) drive, and/or digital versatile disk (DVD) drive, among other examples. The processing system 300 may be communicatively connected with an external storage medium 334 via the interface circuit 324. The external storage medium 334 may be or comprise a removable storage medium (e.g., a CD or DVD), such as may be operable to store data and program code instructions 332.

As described above, the program code instructions 332 and other data (e.g., sensor data or measurements database) may be stored in the mass storage device 330, the main memory 316, the local memory 314, and/or the removable storage medium 334. Thus, the processing system 300 may be implemented in accordance with hardware (perhaps implemented in one or more chips including an integrated circuit, such as an ASIC), or may be implemented as software or firmware for execution by the processor 312. In the case of firmware or software, the implementation may be provided as a computer program product including a non-transitory, computer-readable medium or storage structure embodying computer program code instructions 332 (i.e., software or firmware) thereon for execution by the processor 312. The program code instructions 332 may include program instructions or computer program code that, when executed by the processor 312, may perform and/or cause performance of example methods, processes, and/or operations described herein.

The present disclosure is further directed to example operations, processes, and/or methods of performing slide drilling operations via a drill string driver, such as rotary table or top drive, according to one or more aspects of the present disclosure. The example methods may be performed utilizing or otherwise in conjunction with at least a portion of one or more implementations of one or more instances of the apparatus shown in one or more of FIGS. 1-3, and/or otherwise within the scope of the present disclosure. For example, the methods may be performed and/or caused, at least partially, by a processing device, such as the processing device 300 executing program code instructions according to one or more aspects of the present disclosure. Thus, the present disclosure is also directed to a non-transitory, computer-readable medium comprising computer program code that, when executed by the processing device, may cause such processing device to perform the example methods described herein. The methods may also or instead be performed and/or caused, at least partially, by a human wellsite operator utilizing one or more instances of the apparatus shown in one or more of FIGS. 1-3, and/or otherwise within the scope of the present disclosure. Thus, the following description of an example method refers to apparatus shown in one or more of FIGS. 1-3. However, the method may also be performed in conjunction with implementations of apparatus other than those depicted in FIGS. 1-3 that are also within the scope of the present disclosure.

An example method according to one or more aspects of the present disclosure may comprise calibrating, selecting, or otherwise determining operational parameters (i.e., characteristics) of rotational (i.e., angular) motion of a top drive (or a rotary table), including operational parameters of rotational oscillations in the clockwise and counterclockwise directions imparted by the top drive to a drill string to increase efficiency of slide drilling operations. Example rotational motion parameters of the top drive may include rotational orientation of the mud motor toolface, rotational speed of the top drive, level of torque generated by the top drive that is required to initiate rotation of the entire drill string, and rotational oscillation distances. The rotational oscillation distances may include a rotational distance (e.g., angle, amplitude, number of rotations) of the top drive in the clockwise direction required to rotate the entire drill string, and a rotational distance of the top drive in the counterclockwise direction required to rotate the entire drill string.

The rotation oscillation parameters of a top drive may be selected via a plurality of method steps or actions performed by various portions of a well construction system, such as the well construction system shown in FIG. 1. Steps or actions may include, for example, initiating flow of fluid (e.g., drilling fluid) through the drill string without rotating the drill string with the top drive. Thereafter, initiating rotation of the drill string via the top drive at a relatively low rotational speed (e.g., between about 10 revolutions per minute (RPM) and about 50 RPM) while the drill string is off-bottom of the wellbore. The rotational oscillation parameters may be determined based on torque and rotational distance measurements taken while initiating rotation of the drill string off-bottom of the wellbore. While rotation of the drill string is initiated, torque of the top drive and rotational distance achieved by the drive shaft of the top drive may be monitored. When the drill string is accelerating, the torque applied to the drill string may be increasing, and when the entire drill string starts to rotate, torque may decrease or remain substantially constant (i.e., unchanged). Thus, a rotational distance at which highest (i.e., maximum) level torque was achieved may be deemed as a reference rotational distance, based on which rotational oscillations imparted at the surface to the drill string may be selected to perform slide drilling. Torque actually applied of the drill string (as opposed to torque applied by a motor to the top-drive) may be utilized as a basis for determining the rotational oscillation parameters.

Figure 4:
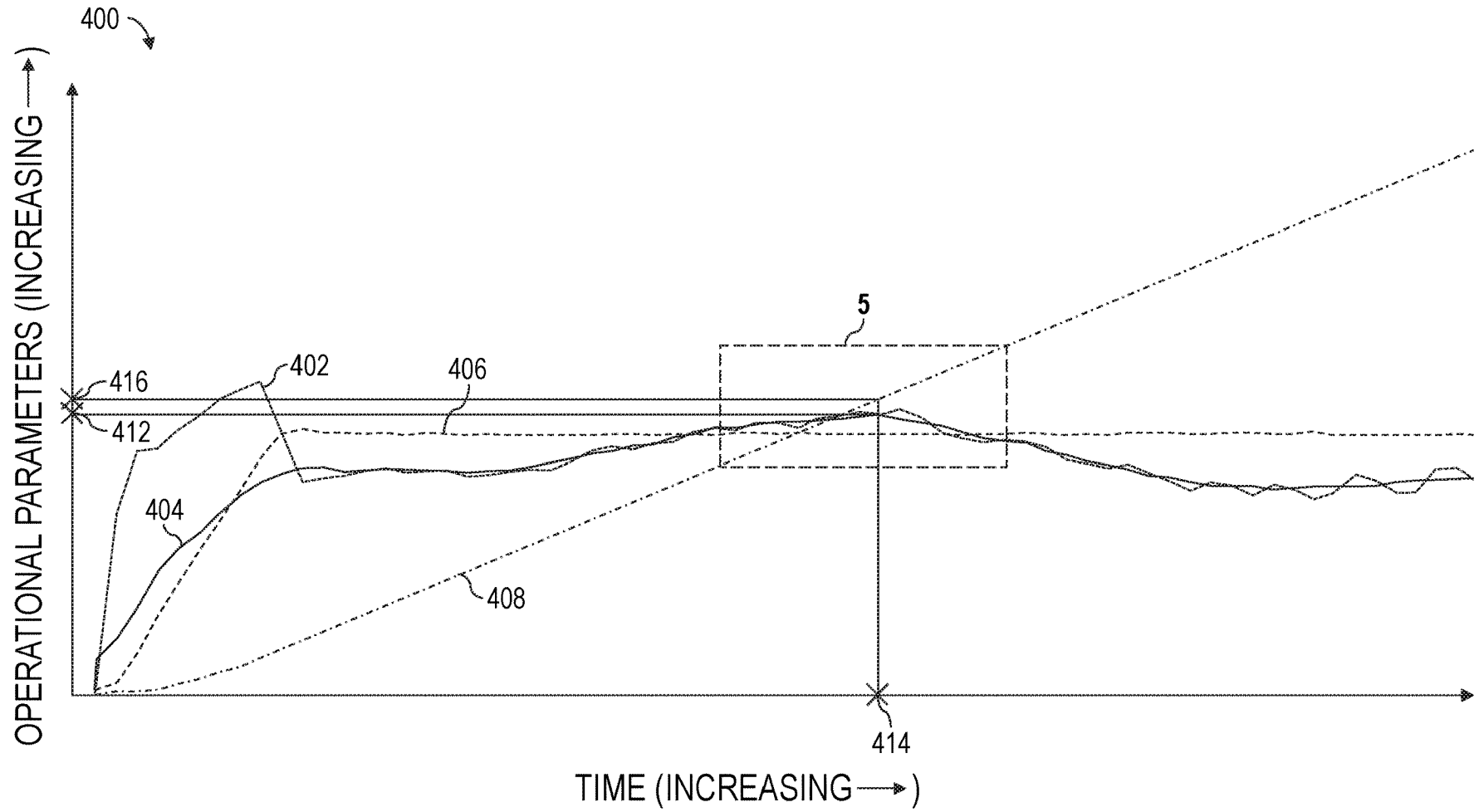
FIGS. 4 and 5 are graphs related to one or more aspects of the present disclosure.
Figure 5:
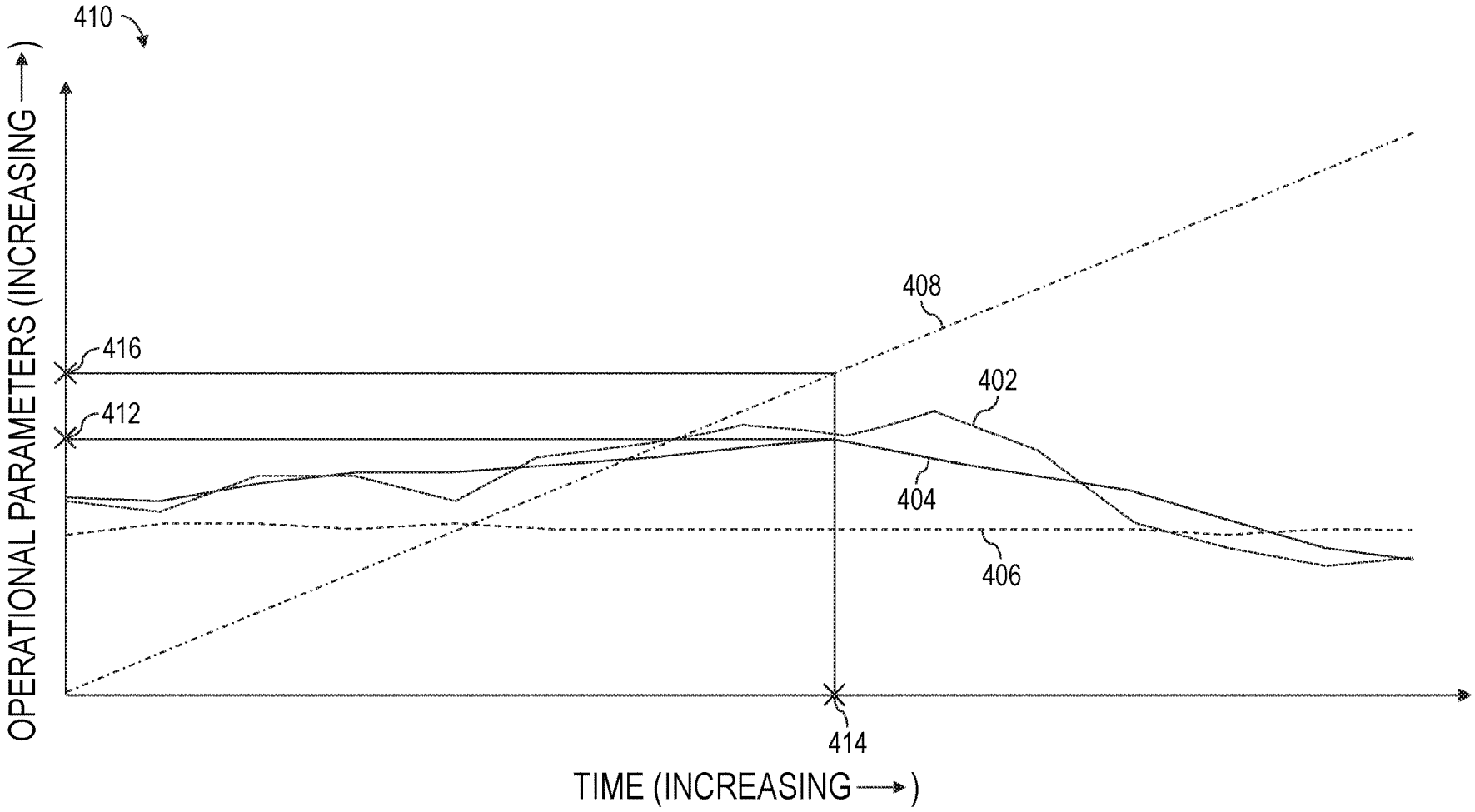

FIG. 4 is a graph 400 showing measurements of various operational parameters of a top drive recorded over time according to one or more aspects of the present disclosure. FIG. 5 is a graph 410 showing an enlarged view of a portion of the graph 400 shown in FIG. 4. The operational parameter measurements are shown plotted along the vertical axis, with respect to time, which is shown plotted along the horizontal axis. The graph 400 may be generated by a processing device, such as the processing device 300 shown in FIG. 3 or one or more of the control devices 204 shown in FIG. 2, based in sensor measurements facilitated by one or more sensors 208, 210 and/or control devices 212 shown in FIG. 2. The following description refers to FIGS. 1-5, collectively.

The graphs 400, 410 show torque 402 generated by a motor of a top drive (hereinafter "top drive torque"), torque 404 applied to the drill string (hereinafter "drill string torque") via a drive shaft of the top drive, rotational speed 406 of the drive shaft of the top drive, and rotational distance 408 (e.g., angle, amplitude, number of rotations) completed by the drive shaft of the top drive.

The drill string torque 404 may be estimated or otherwise determined by utilizing Equation (1) set forth below.

$$T_{ds}=T_{td}-J_{td}\alpha_{td} \tag{1}$$

where $T_{ds}$ is the drill string torque 404, $T_{td}$ is the top drive torque 402 measured via a VFD (e.g., the first control device 212), $J_{td}$ is a rotational inertia of the top drive, and $\alpha_{td}$ is a rotational acceleration of the top drive. The rotational acceleration $\alpha_{td}$ may be determined by utilizing Equation (2) set forth below.

$$\alpha_{td} = \frac{\omega_2 - \omega_1}{dt} \tag{2}$$

where $\omega_2$ indicates rotational speed of the top drive at current time instance, $\omega_1$ indicates rotational speed of the top drive at a previous time instance, and dt indicates a time interval between the current and previous time instances. However, if a torque sub (e.g., the torque sub 210) is used to determine the torque applied to the drill string, then Equations (1) and (2) may be disregarded and the drill string torque 404 may be deemed as being equal to the torque measurements facilitated by the torque sub.

The sensor signals (i.e., measurements) indicative of torque 402, rotational distance 408, and/or rotational speed 406 generated or output by one or more of the sensors 208, 210 and the first control device 212 may comprise high frequency noise, which may be filtered out via a low-pass filter before being received, processed, and/or utilized by the processing device. The sensor signals may be filtered in real time while the sensor signals are output, or the sensor signals may be recorded for a predetermined period of time and then filtered via a zero-phase filtering means.

The graphs 400, 410 show that the drill string torque 404 reaches the highest level (i.e., maximum) drill string torque 412 at about time 414. Examining the rotational distance 408 at time 414, the graphs 400, 410 further show that the top drive has completed a rotational distance 416. Based on graphs 400, 410, a level of torque imparted by the top drive required to initiate rotation of the drill string (hereinafter "torque $T_0$") may be estimated or otherwise selected by deeming the maximum drill string torque 412 as the torque $T_0$. Furthermore, a rotational distance (e.g., angle, amplitude, number of rotations) required to initiate rotation of the entire drill string (hereinafter "rotational distance $\theta_0$") may be estimated or otherwise selected by deeming the rotational distance 416 as the rotational distance $\theta_0$. The rotational distance $\theta_0$ is a rotational distance of the drive shaft of the top drive and, thus, of the top end of the drill string, that is required to initiate or achieve rotation of the entire drill string. In other words, the rotational distance $\theta_0$ is a rotational distance of the top drive that causes the bottom end of the drill string to start to rotate. A more accurate value of rotational distance $\theta_0$ may be realized by slowing the rotational acceleration rate of the top drive from zero RPM to nominal RPM and/or by lowering the value of the nominal RPM. After being determined, the rotational distance $\theta_0$ may be deemed or used as a reference rotational distance, which may be utilized to scale or otherwise as a basis for alternating (i.e., oscillating) rotational (i.e., clockwise and counterclockwise) motions of the top drive that are imparted to the upper end (i.e., surface end) of the drill string while performing slide drilling. The reference rotational distance may, thus, be or form a basis for determining target rotational distance(s) of the top drive that are imparted to the upper end of the drill string while performing slide drilling.

The alternating rotational motions may be imparted to the upper end of the drill string at the wellsite surface by the top drive with respect to an initial rotational position of the drill string, in which a toolface of a bent mud motor is oriented in an intended direction (e.g., intended direction of drilling). The rotational distances of the alternating rotational motions imparted to the drill string by the top drive may be measured at the wellsite surface, such as by a sensor associated with the top drive. During slide drilling, the alternating rotational motions imparted by the top drive may alternatingly rotate the top of the drill string by or otherwise based on the reference rotational distance with respect to the initial rotational position. For example, a target rotational distance may be or comprise the substantially exact value of the reference rotational distance, a portion or fraction of the value of the reference rotational distance, or more than the value of the reference rotational distance. The alternating rotational motions imparted by the top drive to the upper end of the drill string may be selected based on the reference rotational distance such that the lower end (i.e., bent motor toolface and the drill bit) of the drill string is maintained substantially static (i.e., in the initial rotational position) or experience alternating rotational motions comprising rotational distances with respect to the initial rotational position that are appreciably less (e.g., close to zero % or degrees, +/−1% or degrees, +/−2% or degrees, +/−5% or degrees, +/−10% or degrees, +/−15% or degrees) than the rotational distances imparted by the top drive to the top of the drill string.

The target alternating rotational distances imparted by the top drive to the upper end of the drill string may be selected to be lesser than the reference rotational distance. For example, the target rotational distances may be between about 50% and 100% of the reference rotational distance, between about 50% and 90% of the reference rotational distance, between about 50% and 80% of the reference rotational distance, between about 60% and 80% of the reference rotational distance, between about 80% and 100% of the reference rotational distance, between about 90% and 100% of the reference rotational distance, or between about 95% and 100% of the reference rotational distance. The target alternating rotational distances imparted by the top drive to the upper end of the drill string may be selected to be greater than the reference rotational distance. For example, the target rotational distances may be between about 100% and 125% of the reference rotational distance, between about 100% and 110% of the reference rotational distance, between about 100% and 105% of the reference rotational distance, or between about 100% and 102% of the reference rotational distance.

A processing device within the scope of the present disclosure, such as the processing device 300 shown in FIG. 3 or one or more of the control devices 204 (e.g., the control device 214 and/or control device 216) shown in FIG. 2, may be operable to control operation of the top drive 116 to rotate the drill string 120 during slide drilling operations. For example, the control device may be operable to output a first control command to the top drive 116 to cause the top drive 116 to rotate the drill string 120, receive rotational position measurements facilitated by the rotation sensor 208 and/or the first control device 212, receive torque measurements facilitated by the torque sensor 210 and/or the first control device 212, determine rotational distance achieved by the top drive 116 based on the rotational position measurements, determine a reference rotational distance of the top drive 116 to be equal to the rotational distance achieved by the top drive 116 at which the torque applied to the drill string 120 by the top drive 116 was at about the highest level, and then during the slide drilling operations, output second control commands to the top drive 116 to cause the top drive 116 to rotate the drill string 120 alternatingly in opposing directions based on the reference rotational distance.

An example method according one or more aspects of the present disclosure may comprise commencing operation of a processing device, such as the processing device 300 shown in FIG. 3 or one or more of the control devices 204 (e.g., control device 214 and/or control device 216) shown in FIG. 2, to operate the top drive 116 to determine a reference rotational distance of the top drive 116 to be utilized during slide drilling. The processing device may operate a drill string hoisting system (e.g., draw works 118) to raise, maintain, or otherwise position the drill string 120 off-bottom of the wellbore 102. The processing device may then output a first control command to the top drive 116 to cause the top drive 116 to rotate the drill string 120, receive rotational distance measurements indicative of the rotational distance achieved by the top drive 116, and receive torque measurements indicative of torque applied to the drill string 120 by the top drive 120. The processing device may further determine a reference rotational distance of the top drive 116 based on the rotational distance measurements and the torque measurements. The processing device may determine the reference rotational distance of the top drive 116 to be equal to the rotational distance achieved by the top drive 116 at which the torque applied to the drill string 120 by the top drive 116 was at about the highest (i.e., maximum) level. To determine the reference rotational distance, the processing device may record the torque measurements and the rotational distance measurements in association with each other, detect, isolate, or otherwise determine what the highest level torque measurement is, and detect, isolate, or otherwise determine what rotational distance measurement is associated with the determined highest level torque measurement. Thereafter, during the slide drilling operations, the processing device may output second control commands to the top drive 116 to cause the top drive 116 to rotate the drill string 120 alternatingly in opposing directions to a target rotational distance based on the reference rotational distance.

The processing device may receive the torque measurements from the torque sensor 210, 212 disposed in association with the top drive 116. The processing device may receive the torque measurements from the torque sub 210 coupled between the drive shaft 125 of the top drive 116 and the drill string 120. The processing device may receive the torque measurements from the VFD 212 driving an electric motor 202 of the top drive 116. The processing device may determine the torque applied to the drill string 120 by the top drive 116 by utilizing Equation (1) set forth above, where $T_{ds}$ is the torque applied to the drill string 120 by the top drive 116, $T_{td}$ is torque of the top drive 116 indicated by the torque measurements output by the VFD 212, $J_{td}$ is a rotational inertia of the top drive 116, and $\alpha_{td}$ is a rotational acceleration of the top drive 116.

The second control commands output by the processing device to the top drive 116 during the slide drilling may cause the top drive 116 to rotate an upper end of the drill string 120 in a first direction from an initial rotational position based on the reference rotational distance, rotate the upper end of the drill string 120 back to the initial rotational position, rotate the upper end of the drill string 120 in a second direction from the initial rotational position based on the reference rotational distance, and rotate the upper end of the drill string 120 back to the initial rotational position. The second control commands output by the processing device to the top drive 116 may cause the top drive 116 to rotate the entire drill string 120 to an initial rotational position such that the mud motor toolface 185 is oriented in an intended direction, and rotate an upper end of the drill string 120 alternatingly in the opposing directions from the initial rotational position based on the reference rotational distance. The second control commands output by the processing device to the top drive 116 may cause the top drive 116 to rotate the drill string 120 alternatingly in a first rotational direction from an initial rotational position until the reference rotational distance is reached, and in a second rotational direction from the initial rotational position until the reference rotational distance is reached. The second control commands output by the processing device to the top drive 116 may cause the top drive 116 to rotate the drill string 120 alternatingly in a first rotational direction from an initial rotational position until a first predetermined fraction of the reference rotational distance is reached, and in a second rotational direction from the initial rotational position until a second predetermined fraction of the reference rotational distance is reached.

Another example method according one or more aspects of the present disclosure may comprise manually or automatically operating portions of the well construction system 100 to perform slide drilling. Manual operations of the well construction system 100 may be performed by a wellsite operator 195 and automatic operations of the well construction system 100 may be performed by a processing device, such as the processing device 300 shown in FIG. 3 or one or more of the control devices 204 (e.g., control device 214 and/or control device 216) shown in FIG. 2.

The method may further comprise calibrating, selecting, or otherwise determining operational parameters (i.e., characteristics) of rotational (i.e., angular) motion of a top drive 116 (or a rotary table), including operational parameters of rotational oscillations in the clockwise and counterclockwise directions imparted by the top drive 116 to a drill string 120 to increase efficiency of drilling operations while performing slide drilling, as described above.

After determining the operational parameters of rotational oscillations, the method may further comprise operating the mud pumps 144 to pump drilling fluid through the drill string 120, operating a mud motor 182 to rotate a drill bit 126 (without rotating the top-drive 116 in either direction), and going on bottom at an intended ROP or hook load. The top drive 116 may then be operated to orient (i.e., rotate) the drill string 120 to an initial rotational position in which the mud motor toolface 185 is oriented in an intended direction.

Thereafter, the top drive 116 may be rotated to rotate the top of the drill string 120 in a first rotational direction (e.g., clockwise direction) to a fraction (e.g., about 60-80%) of the determined reference rotational distance at a relatively low rotational speed (e.g., about 5-30 RPM). The top of the drill string 120 may then be rotated back to the initial rotational position, and then rotated in a second direction (e.g., counterclockwise direction) to a fraction (e.g., about 60-80%) of the determined reference rotational distance at a relatively low rotational speed (e.g., about 5-30 RPM). The top of the drill string 120 may then be rotated back to the initial rotational position. Such rotation of the top drive 116 may be repeated while monitoring orientation (i.e., rotational direction) of the lower end (i.e., mud motor toolface 185) of the drill string 120. The orientation of the mud motor toolface 185 may be monitored via a sensor 186 of the downhole tool 180 (e.g., a MWD or LWD tool and mud-pulse telemetry or wired drill pipe).

The rotational distance imparted by the top drive 116 may be changed (e.g., increased or decreased) depending on the determined orientation of the mud motor toolface 185. For example, if during slide drilling the mud motor toolface 185 is changing more than an intended amount, the processing device or the wellsite operator 195 may decrease the rotational distance to a smaller fraction of the reference rotational distance. Furthermore, if the orientation of the mud motor toolface 185 is not as intended, the initial rotational position of the top drive oscillations may be changed. For example, to rotate the mud motor toolface 185 in the clockwise direction, the initial rotational position can be moved in the clockwise direction. This is equivalent to leaving the initial rotational position unchanged and instead increasing the rotational distance of clockwise oscillations and decreasing the rotational distance of counterclockwise oscillations. Similarly, if the orientation (i.e., direction) of the mud motor toolface 185 shifts or is otherwise not as intended (i.e., comprises an orientation error), the orientation of the mud motor toolface 185 can be moved or otherwise corrected by increasing the rotational distance of oscillations in one direction and decreasing the rotational distance of oscillations in the opposing direction, thereby having the effect of changing (i.e., shifting) the orientation of the mud motor toolface 185. While slide drilling, the processing device or the wellsite operator 195 may also compensate for other drilling parameters. For example, the rotational distance of oscillation may be modified depending on measured values of hook load and/or standpipe pressure (e.g., relative to an off-bottom reference).

One or more portions of the methods described above may be performed manually by the wellsite operator 195 and/or by a processing device, such as the processing device 300 shown in FIG. 3 or one or more of the control devices 204 (e.g., control device 214 and/or control device 216) shown in FIG. 2. In addition, an orchestration software may be implemented by the processing device to automatically change the operational parameters of rotational oscillations imparted to the drill string by the top drive 116 (e.g., rotational distance and initial position) to achieve the intended orientation of the mud motor toolface 185.

In view of the entirety of the present disclosure, including the figures and the claims, a person having ordinary skill in the art will readily recognize that the present disclosure introduces an apparatus comprising: a rotation sensor operable to facilitate rotational distance measurements indicative of rotational distance achieved by a top drive; an electrical device operable to facilitate torque measurements indicative of torque applied to a drill string by the top drive; and a processing device comprising a processor and a memory storing computer program code. The processing device is operable to: output a first control command to cause the top drive to rotate the drill string; determine a reference rotational distance based on the rotational distance measurements and the torque measurements; and, during slide drilling operations, output second control commands to cause the top drive to alternatingly rotate the drill string in opposing directions based on the determined reference rotational distance.

The processing device may be operable to determine the reference rotational distance as that which is equal to the rotational distance achieved by the top drive at a maximum torque applied to the drill string by the top drive.

The processing device may be operable to: record the torque measurements and the rotational distance measurements in association with each other; determine a maximum torque measurement; and determine the reference rotational distance as being one of the rotational distance measurements that is associated with the determined maximum torque measurement.

The rotation sensor may be or comprise an encoder disposed in association with the top drive.

The electrical device may be or comprise a torque sensor disposed in association with the top drive.

The electrical device may be or comprise a VFD driving an electric motor of the top drive.

The second control commands may cause the top drive to: rotate to an initial rotational position; then rotate from the initial rotational position in a first rotational direction based on the reference rotational distance; then rotate in a second rotational direction to the initial rotational position; then rotate from the initial rotational position in the second rotational direction based on the reference rotational distance; and then rotate in the first rotational direction to the initial rotational position.

The second control commands may cause the top drive to: rotate to an initial rotational position such that a toolface of a bent mud motor is oriented in an intended direction; and then alternatingly rotate in the opposing directions from the initial rotational position based on the reference rotational distance.

The second control commands may cause the top drive to rotate: in a first rotational direction from an initial rotational position until a first predetermined fraction of the reference rotational distance is reached; and in a second rotational direction from the initial rotational position until a second predetermined fraction of the reference rotational distance is reached.

The present disclosure also introduces an apparatus comprising: a rotation sensor operable to facilitate rotational distance measurements indicative of rotational distance achieved by a top drive; an electrical device operable to facilitate torque measurements indicative of torque applied to a drill string by the top drive; and a processing device comprising a processor and a memory storing computer program code. The processing device is operable to: output a first control command to the top drive to cause the top drive to rotate the drill string; determine a reference rotational distance of the top drive based on the rotational distance measurements and the torque measurements; and, during slide drilling operations, output second control commands to the top drive to cause the top drive to rotate the drill string alternatingly in opposing directions based on the reference rotational distance.

The processing device may be operable to determine the reference rotational distance of the top drive to be equal to the rotational distance achieved by the top drive at which the torque applied to the drill string by the top drive was at about the highest level. The processing device may be operable to: record the torque measurements and the rotational distance measurements in association with each other; determine a highest level torque measurement; and determine a rotational distance measurement associated with the determined highest level torque measurement to be equal to the reference rotational distance.

The rotation sensor may be or comprise an encoder disposed in association with the top drive.

The electrical device may be or comprise a torque sensor disposed in association with the top drive.

The electrical device may be or comprise a torque sub coupled between a drive shaft of the top drive and the drill string.

The electrical device may be or comprise a VFD driving an electric motor of the top drive.

The processing device may be operable to determine the torque applied to the drill string by the top drive by utilizing Equation (1) set forth above.

The second control commands output by the processing device to the top drive during the slide drilling operations may cause the top drive to: rotate to an initial rotational position; rotate in a first rotational direction based on the reference rotational distance; rotate back to the initial rotational position; rotate in a second rotational direction based on the reference rotational distance; and rotate back to the initial rotational position.

The second control commands output by the processing device to the top drive may cause the top drive to: rotate to an initial rotational position such that the toolface of a bent mud motor is oriented in an intended direction; and rotate alternatingly in the opposing directions from the initial rotational position based on the reference rotational distance.

The second control commands output by the processing device to the top drive may cause the top drive to rotate alternatingly: in a first rotational direction from an initial rotational position until a first predetermined fraction of the reference rotational distance is reached; and in a second rotational direction from the initial rotational position until a second predetermined fraction of the reference rotational distance is reached.

The present disclosure also introduces a method comprising commencing operation of a processing device to determine a reference rotational distance of a top drive to be utilized during slide drilling, wherein the processing device: outputs a control command to the top drive to cause the top drive to rotate a drill string; and determines the reference rotational distance based on rotational distance measurements indicative of rotational distance achieved by the top drive and torque measurements indicative of torque applied to the drill string by the top drive.

The processing device may determine the reference rotational distance of the top drive to be equal to the rotational distance achieved by the top drive at which the torque applied to the drill string by the top drive was at about the highest level. The processing device may: record the torque measurements and the rotational distance measurements in association with each other; determine a highest level torque measurement; and determine a rotational distance measurement associated with the determined highest level torque measurement to be equal to the reference rotational distance.

The processing device may receive the rotational distance measurements and the torque measurements.

The processing device may receive the torque measurements from a torque sensor disposed in association with the top drive, a torque sub coupled between a drive shaft of the top drive and the drill string, and/or a VFD driving an electric motor of the top drive.

The processing device may determine the torque applied to the drill string by the top drive by utilizing Equation (1) set forth above.

The control command may be a first control command, and during the slide drilling the processing device may output second control commands to the top drive to cause the top drive to rotate the drill string alternatingly in opposing directions based on the reference rotational distance. The second control commands output by the processing device to the top drive during the slide drilling may cause the top drive to: rotate to an initial rotational position; rotate in a first rotational direction based on the reference rotational distance; rotate back to the initial rotational position; rotate in a second rotational direction based on the reference rotational distance; and rotate back to the initial rotational position. The second control commands output by the processing device to the top drive may cause the top drive to: rotate to an initial rotational position such that the toolface of a bent mud motor is oriented in an intended direction; and rotate alternatingly in the opposing directions from the initial rotational position based on the reference rotational distance. The second control commands output by the processing device to the top drive may cause the top drive to rotate alternatingly: in a first rotational direction from an initial rotational position until a first predetermined fraction of the reference rotational distance is reached; and in a second rotational direction from the initial rotational position until a second predetermined fraction of the reference rotational distance is reached.

The present disclosure also introduces method comprising commencing operation of a processing device to determine a reference rotational distance of a top drive to be utilized during slide drilling, wherein the processing device: outputs a control command to the top drive to cause the top drive to rotate a drill string; receives rotational distance measurements indicative of rotational distance achieved by the top drive; receives torque measurements indicative of torque applied to the drill string by the top drive; and determines the reference rotational distance based on the rotational distance measurements and the torque measurements.

The processing device may determine the reference rotational distance to be equal to the rotational distance achieved by the top drive at which the torque applied to the drill string by the top drive was at about the highest level. The processing device may: record the torque measurements and the rotational distance measurements in association with each other; determine a highest level torque measurement; and determine a rotational distance measurement associated with the determined highest level torque measurement to be equal to the reference rotational distance.

The processing device may receive the torque measurements from a torque sensor disposed in association with the top drive, a torque sub coupled between a drive shaft of the top drive and the drill string, and/or a VFD drive driving an electric motor of the top drive.

The processing device may determine the torque applied to the drill string by the top drive by utilizing Equation (1) set forth above.

The control command may be a first control command, and during the slide drilling the processing device may output second control commands to the top drive to cause the top drive to rotate the drill string alternatingly in opposing directions based on the reference rotational distance. The second control commands output by the processing device to the top drive during the slide drilling may cause the top drive to: rotate to an initial rotational position; rotate in a first rotational direction based on the reference rotational distance; rotate back to the initial rotational position; rotate in a second rotational direction based on the reference rotational distance; and rotate back to the initial rotational position. The second control commands output by the processing device to the top drive may cause the top drive to: rotate to an initial rotational position such that the toolface of a bent mud motor is oriented in an intended direction; and rotate alternatingly in the opposing directions from the initial rotational position based on the reference rotational distance. The second control commands output by the processing device to the top drive may cause the top drive to rotate alternatingly: in a first rotational direction from an initial rotational position until a first predetermined fraction of the reference rotational distance is reached; and in a second rotational direction from the initial rotational position until a second predetermined fraction of the reference rotational distance is reached.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a rotation sensor operable to facilitate rotational distance measurements indicative of rotational distance achieved by a top drive;

an electrical device operable to facilitate torque measurements indicative of torque applied to a drill string by the top drive; and a processing device comprising a processor and a memory storing computer program code, wherein the processing device is operable to:

output a first control command to cause the top drive to rotate the drill string;

determine a reference rotational distance based on the rotational distance measurements and the torque measurements; and during slide drilling operations, output second control commands to cause the top drive to alternatingly rotate the drill string in opposing first and second rotational directions based on the determined reference rotational distance, wherein the second control commands cause the top drive to:

during the slide drilling operations as initiated after pumping drilling fluid through the drill string to operate a mud motor of the drill string to rotate a drill bit of the drill string and going on bottom of a wellbore with the drill bit at an intended rate of penetration or hook load, rotate to an initial rotational position;

then rotate from the initial rotational position in the first rotational direction based on the reference rotational distance;

then rotate in the second rotational direction to the initial rotational position;

then rotate from the initial rotational position in the second rotational direction based on the reference rotational distance; and then rotate in the first rotational direction to the initial rotational position.

2. The apparatus of claim 1, wherein the processing device is operable to determine the reference rotational distance as that which is equal to the rotational distance achieved by the top drive at a maximum torque applied to the drill string by the top drive without the drill bit of the drill string being in contact with the bottom of the wellbore.

3. The apparatus of claim 1, wherein the processing device is operable to:

record the torque measurements and the rotational distance measurements in association with each other;

determine a maximum torque measurement without the drill bit of the drill string being in contact with the bottom of the wellbore; and determine the reference rotational distance as being one of the rotational distance measurements that is associated with the determined maximum torque measurement.

4. The apparatus of claim 1, wherein the rotation sensor is or comprises an encoder disposed in association with the top drive.

5. The apparatus of claim 1, wherein the electrical device is or comprises a torque sensor disposed in association with the top drive.

6. The apparatus of claim 1, wherein the electrical device is or comprises a variable frequency drive driving an electric motor of the top drive.

7. The apparatus of claim 1, wherein the second control commands cause the top drive to:

rotate to the initial rotational position such that a toolface of the mud motor is oriented in an intended direction; and then alternatingly rotate in the opposing first and second rotational directions from the initial rotational position based on the reference rotational distance.

8. The apparatus of claim 1, wherein the second control commands cause the top drive to rotate:

in the first rotational direction from the initial rotational position until a first predetermined fraction of the reference rotational distance is reached; and in the second rotational direction from the initial rotational position until a second predetermined fraction of the reference rotational distance is reached.

9. A method comprising:

commencing operation of a processing device to determine a reference rotational distance of a top drive to be utilized during slide drilling, wherein the processing device:

outputs a first control command to cause the top drive to rotate a drill string; and determines the reference rotational distance based on rotational distance measurements indicative of rotational distance achieved by the top drive and torque measurements indicative of torque applied to the drill string by the top drive, wherein the rotational distance measurements are obtained via a rotation sensor, and the torque measurements are obtained via an electrical device; and during the slide drilling, the processing device outputs second control commands to cause the top drive to alternatingly rotate the drill string in opposing first and second rotational directions based on the reference rotational distance, wherein the second control commands cause the top drive to:

during the slide drilling as initiated after pumping drilling fluid through the drill string to operate a mud motor of the drill string to rotate a drill bit of the drill string and going on bottom of a wellbore with the drill bit at an intended rate of penetration or hook load, rotate to an initial rotational position;

then rotate from the initial rotational position in the first rotational direction based on the reference rotational distance;

then rotate in the second rotational direction to the initial rotational position;

then rotate from the initial rotational position in the second rotational direction based on the reference rotational distance; and then rotate in the first rotational direction to the initial rotational position.

10. The method of claim 9, wherein the processing device determines the reference rotational distance of the top drive as equal to rotational distance achieved by the top drive at which torque applied to the drill string by the top drive was at about the highest level.

11. The method of claim 9, wherein the processing device:

records the torque measurements and the rotational distance measurements in association with each other;

determines a highest level torque measurement; and determines the reference rotational distance to be one of the rotational distance measurements associated with the determined highest level torque measurement.

12. The method of claim 9, wherein the processing device receives the torque measurements from one or more of:

a torque sensor disposed in association with the top drive;

a torque sub coupled between a drive shaft of the top drive and the drill string; and a variable frequency drive driving an electric motor of the top drive.

13. The method of claim 9, wherein the second control commands cause the top drive to:

rotate to the initial rotational position such that a toolface of the mud motor is oriented in an intended direction; and rotate alternatingly in the opposing first and second rotational directions from the initial rotational position based on the reference rotational distance.

14. The method of claim 9, wherein the second control commands cause the top drive to rotate alternatingly:

in the first rotational direction from the initial rotational position until a first predetermined fraction of the reference rotational distance is reached; and in the second rotational direction from the initial rotational position until a second predetermined fraction of the reference rotational distance is reached.

15. A method comprising:

commencing operation of a processing device to determine a reference rotational distance of a top drive to be utilized during slide drilling, wherein the processing device:

outputs a first control command to the top drive to cause the top drive to rotate a drill string;

receives, via a rotational sensor, rotational distance measurements indicative of rotational distance achieved by the top drive;

receives, via an electrical device, torque measurements indicative of torque applied to the drill string by the top drive; and determines the reference rotational distance based on the rotational distance measurements and the torque measurements, and during the slide drilling, the processing device outputs second control commands to cause the top drive to alternatingly rotate the drill string in opposing first and second rotational directions based on the reference rotational distance, wherein the second control commands cause the top drive to:

during the slide drilling as initiated after pumping drilling fluid through the drill string to operate a mud motor of the drill string to rotate a drill bit of the drill string and going on bottom of a wellbore with the drill bit at an intended rate of penetration or hook load, rotate to an initial rotational position;

then rotate from the initial rotational position in the first rotational direction based on the reference rotational distance;

then rotate in the second rotational direction to the initial rotational position;

then rotate from the initial rotational position in the second rotational direction based on the reference rotational distance; and then rotate in the first rotational direction to the initial rotational position.

16. The method of claim 15, wherein the processing device determines the reference rotational distance to be equal to the rotational distance achieved by the top drive at which the torque applied to the drill string by the top drive was at about the highest level.

17. The method of claim 15, wherein the processing device further:

records the torque measurements and the rotational distance measurements in association with each other;

determines a highest level torque measurement; and determines a rotational distance measurement associated with the determined highest level torque measurement to be equal to the reference rotational distance.

* * * * *